US010350772B2

(12) United States Patent
Fischer et al.

(10) Patent No.: US 10,350,772 B2
(45) Date of Patent: Jul. 16, 2019

(54) ELECTRICALLY DRIVEN DEVICE

(71) Applicant: Braun GmbH, Kronberg (DE)

(72) Inventors: Uwe Fischer, Darmstadt (DE); Johannes Stimpel, Wiesbaden (DE); Cirilo Javier Perez Lopez, Frankfurt am Main (DE); Andreas Erndt, Kelkheim (DE); Detlef Gleich, Friedrichsdorf (DE); Sebastian Hottenrott, Idstein (DE); Michael Steghaus, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 0 days.

(21) Appl. No.: 15/710,915

(22) Filed: Sep. 21, 2017

(65) Prior Publication Data

US 2018/0085947 A1 Mar. 29, 2018

(30) Foreign Application Priority Data

Sep. 28, 2016 (EP) ..... 16191093

(51) Int. Cl.
*B26B 19/28* (2006.01)
*B26B 19/38* (2006.01)
*B26B 19/12* (2006.01)

(52) U.S. Cl.
CPC ..... *B26B 19/28* (2013.01); *B26B 19/12* (2013.01); *B26B 19/288* (2013.01); *B26B 19/388* (2013.01)

(58) Field of Classification Search
CPC ..... B26B 19/12; B26B 19/288; B26B 19/388
(Continued)

(56) References Cited

U.S. PATENT DOCUMENTS 4,167,060 A 9/1979 Sakamoto
4,312,126 A * 1/1982 Rochelt ..... B26B 19/02 30/43.92

(Continued)

FOREIGN PATENT DOCUMENTS

DE 1052266 3/1959
GB 825851 12/1959

OTHER PUBLICATIONS

European search report dated Mar. 13, 2017.

*Primary Examiner* — Phong H Nguyen
(74) *Attorney, Agent, or Firm* — Ronald T. Sia; Kevin C. Johnson

(57) ABSTRACT

An electrically driven device provided with a housing, an electric motor with a drive shaft having a first rotary axis and a drive pin connected to the drive shaft eccentrically with respect to the rotary axis, and a driven shaft mounted in the housing for performing a pivoting is disclosed. The driven shaft is indirectly coupled to the drive shaft by means of a gear mechanism converting a rotary motion of the drive shaft into a reciprocating pivoting motion of the driven shaft. The gear mechanism comprises one intermediate shaft having a second rotary axis extending in the longitudinal direction of the intermediate shaft and at least one crank arm coupled to the drive pin. The crank arm is pivotably mounted in the housing and is coupled to the intermediate shaft thereby converting a rotary motion of the drive shaft into a reciprocating pivoting of the intermediate shaft about the second rotary axis. The intermediate shaft is coupled to the at least one driven shaft by means of a pivotable bridge such that the intermediate shaft is offset with respect to the at least one driven shaft.

16 Claims, 7 Drawing Sheets

(58) Field of Classification Search
USPC ..... 30/42, 43, 43.7–43.9, 44, 45
See application file for complete search history.

(56) References Cited

U.S. PATENT DOCUMENTS 4,660,283 A * 4/1987 Yasunaka ..... B26B 19/04
30/43.92
5,207,731 A * 5/1993 Bukoschek ..... B26B 19/04
30/43.7
5,679,991 A * 10/1997 Wolf ..... B26B 19/04
310/37

* cited by examiner

ELECTRICALLY DRIVEN DEVICE

FIELD OF THE INVENTION

The present invention is concerned with an electrically driven device, for example an electric hair removal device, such as a shaver.

BACKGROUND OF THE INVENTION

EP 2 024 147 B1 discloses an electric shaver comprising a housing, an electric motor mounted in the housing and comprising a drive shaft having a first rotary axis, a drive pin connected to the drive shaft eccentrically with respect to the rotary axis, and at least one driven shaft mounted in the housing for performing a movement relative to the housing. The driven shaft is indirectly coupled to the drive shaft by means of a gear mechanism converting a rotary motion of the drive shaft into a reciprocating motion of the driven shaft. The driven shaft is coupled to a cutter element of the shaver. The gear mechanism comprises a swing bridge. A further electric shaver comprising such a gear mechanism with a swing bridge is known e.g. from U.S. Pat. No. 4,167,060.

Further dry shavers are provided with a motor in a body portion of the housing, a drive-train arranged in the body and drive pins arranged relative to the body combined with a shaver head that is flexibly connected to the body. Typically the transfer of the rotation of the eccentric drive pin of the motor into a lateral or linear movement is realized via a so called "oscillating bridge", a combination of a four bar joint mechanism with a groove where the eccentric of the motor is rotating in. The oscillating bridge transfers rotation into linear oscillation, transmits the mechanical energy of the motor to the head with the cutting elements and provides a spring load to the drive system that improves the energy balance of the dynamic system. Relative movements of the head towards the components arranged in the body and angled head to body arrangements may cause restrictions for the efficient and effective flow of forces from the motor to the head and the cutting elements. Further, this may cause unwanted friction, noise, wear and tear, technical complexity which comes along with cost and installation space requirements resulting in a bulky head design. At the same time these type of drive systems tend to be soft in their mechanical power transmission properties, e.g. the output value of deflection divided through the input value of deflection results in values lower 0.9 (effectiveness<0.9). The value for effectiveness in known solutions is significantly affected by the product architecture of a shaver, and there in particular via the inclination of the head towards the body.

As angled product architectures make the power flow go around the corner, the known solutions either connect the motor with the head, which results in bulky and misbalanced heads, or implement the motor in an inclined position relative to the body, which results in bulky bodies or complicated inner product architecture, or the inclination is compensated in an oscillating bridge, which typically results in a bulky handle or in reduced effectiveness of the transmission.

It is an object of the present disclosure to provide an electrically driven device permitting more flexibility regarding the design of the device. It is a further object to provide a device with a high dynamical stiffness of the gear mechanism.

SUMMARY OF THE INVENTION

In accordance with one aspect there is provided an electrically driven device comprising a housing, an electric motor mounted in the housing and comprising a drive shaft having a first rotary axis, a drive pin connected to the drive shaft eccentrically with respect to the rotary axis, and a driven shaft having a second axis and mounted in the housing for performing a movement relative to the housing. The driven shaft may be indirectly coupled to the drive shaft by means of a gear mechanism converting a rotary motion of the drive shaft into a reciprocating motion of the at least one driven shaft. The gear mechanism may comprise an intermediate shaft having a second rotary axis extending in the longitudinal direction of the intermediate shaft and at least one crank arm coupled to the drive pin, wherein the crank arm is pivotably mounted in the housing and is coupled to the intermediate shaft thereby converting a rotary motion of the drive shaft into a reciprocating pivoting of the intermediate shaft about the second rotary axis, wherein the intermediate shaft is coupled to the at least one driven shaft by means of a pivotable bridge such that the at least one driven shaft is offset with respect to the intermediate shaft.

With the drive shaft of the motor being connected to the intermediate shaft by means of the drive pin and the crank arm and with the intermediate shaft being connected to the at least one driven shaft by means of the bridge, the drive train provides for an increased dynamical stiffness. For example, the provision of the intermediate shaft which transmits movements as a reciprocating rotation even over a long distance about its axis increases the dynamical stiffness compared with a design which would exert a bending load on a shaft.

There are different ways to assess the dynamical stiffness of the drive train. For example, the cutter of a shaver may be blocked while the motor is in operation. In a highly soft drive train, this would not stop the motor from rotating the drive shaft because the drive train may elastically compensate the blocked cutter. In contrast to that a stiff drivetrain would immediately stop the motor from further rotation. Another way of assessing the dynamical stiffness is to determine whether the rotation of the drive shaft is directly translated into the reciprocating movement of a driven shaft, which indicates a high dynamical stiffness, or whether superimposed movements occur as a result of a lower dynamical stiffness.

In addition to the above mentioned design of the drive train with an intermediate shaft transmitting movement from the drive shaft to the driven shaft, the dynamical stiffness may be further increased by selecting the component parts appropriately. For example, the intermediate shaft may be a metal shaft with a high torsional strength. Further, the crank arm and the bridge may be rigid by selecting a stiff material and/or by designing the component parts to avoid unintended elastic deformation.

According to a further aspect of the present disclosure, an electric shaver may comprise a shaver body housing, a shaving head housing that is connected to the shaver housing and which carries at least two shaving sub-assemblies with linearly movable cutting elements, a motor with a rotating shaft located in the shaver body housing, a gear mechanism converting a continuous rotation from the motor to an oscillating rotating movement and transferring said oscillating rotating movement to a single oscillating rotating intermediate shaft, with said intermediate shaft transferring the said movement from the shaver body housing to the shaver head, and a distributer plate transmitting the reciprocating rotating movement of the single oscillating intermediate shaft to the cutting elements. Preferably, said gear mechanism may be located close to the motor and said distributer plate may be located close to the cutting elements with said intermediate shaft connecting one or more component parts of the gear mechanism and the distributor plate.

The gear mechanism may comprise a scotch yoke mechanism, i.e. a slotted link mechanism, converting a rotary motion of the drive shaft into a reciprocating pivoting motion of the intermediate shaft of e.g. 4° to 10°, preferably about 6° to about 7°.

DETAILED DESCRIPTION OF THE INVENTION

Figure 1:
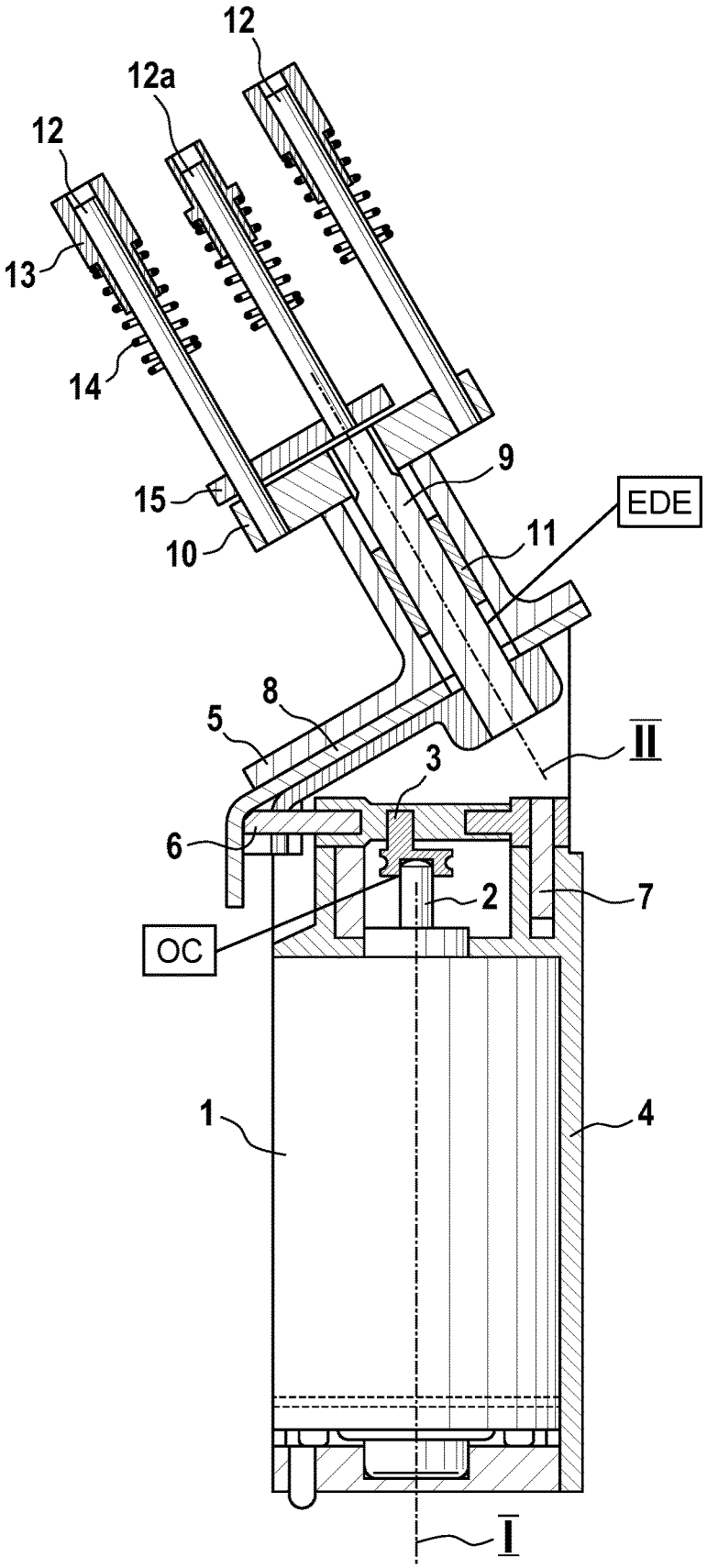
FIG. 1 shows a sectional view of a device according to a first embodiment.

The at least one driven shaft is indirectly mounted in the housing by means of the intermediate shaft and the pivoting bridge which may carry of the at least one driven shaft. The intermediate shaft may be guided within the housing or a component part constrained to the housing, for example a frame or the like, thereby indirectly guiding the at least one driven shaft via the pivotable bridge which couples the at least one driven shaft to the intermediate shaft. An electric shaver may have one or more cutter blocks, e.g. non-foil type cutter units. Accordingly, the pivotable bridge may be connected to one or more cutter blocks. If two or more cutter blocks are provided it is preferred that at least two cutter blocks are driven to move in opposite directions, e.g. by arranging the driven shafts for these cutter blocks on opposite sides of the bridge with respect to the intermediate shaft.

According to a first arrangement of the electrically driven device, the gear mechanism may comprise a first crank arm and a second crank arm. The first crank arm may be pivotably mounted in the housing and coupled to the drive pin. The second crank arm may be mounted pivotably about the intermediate shaft and may be coupling the first crank arm to the intermediate shaft. In other words, the gear mechanism comprises two different crank arms with the first crank arm translating a continuous rotation of the drive pin into a reciprocating pivoting of the first crank arm, whereas the second crank arm transfers the reciprocating pivoting movement to the intermediate shaft. In this respect, the first crank arm may be provided with the recess or opening receiving a pin of the second crank arm to transfer the reciprocating pivoting movement from the first crank arm to the second crank arm.

For example, the intermediate shaft may be rotatably guided in the housing and may be rotationally constrained to the second crank arm. The degree of freedom regarding the design of the electrically driven device may be further enhanced if the first crank arm is pivotable about an axis parallel to the first rotary axis and the second crank arm is pivotable about an axis parallel to the second rotary axis. With the first rotary axis and the second rotary axis being inclined with respect to each other, the electrically driven device may be provided with a main body or handle and a head, e.g. a shaver head, which is arranged angled with respect to the main body or handle.

According to the second arrangement of the electrically driven device, the gear mechanism may comprise a crank arm, e.g. one single crank arm, which is pivotably mounted in the housing, coupled to the drive pin and rotationally constrained to the intermediate shaft. In other words, compared with the first arrangement of the electrically driven device, two separate crank arms may be substituted by a single crank arm. This reduces the number of component parts and facilitates assembly of the device. Again, the intermediate shaft may be inclined with respect to the drive pin.

The number of component parts of the electrically driven device may be further reduced if the crank arm is an integral part of the intermediate shaft. For example, the intermediate shaft may be a hollow shaft internally guided in the housing by means of a bearing pin. The bearing pin may be constrained to the housing of the device either directly or indirectly, e.g. by means of a frame or the like. The bearing pin may be provided with bearing sleeves guiding the hollow intermediate shaft. As an alternative, the intermediate shaft may be externally guided in the housing by means of at least one bearing sleeve which may be constrained to the housing directly or indirectly, e.g. by means of a frame or the like.

The drive pin may be coupled to the at least one crank arm with a clearance fit in at least one direction perpendicular to the first rotary axis, e.g. with a slotted hole. As an alternative, the drive pin may be provided with a bearing element sliding in a respective guiding structure of the crank arm.

The first rotary axis may be inclined with respect to the second rotary axis. In more detail, the eccentric drive pin may extend parallel to the first rotary axis and the intermediate shaft and the at least one driven shaft may extend parallel to the second rotary axis. With the electrically driven device being an electric shaver this arrangement permits to provide the shaver head inclined or angled with respect to the shaver body. In addition, the gear mechanism with the intermediate shaft allows a design of a shaver or the like device with a constricted neck between a body portion and a head portion.

The pivotable bridge may be rotationally constrained to the at least one driven shaft. The at least one driven shaft and the pivotable bridge may be separate component parts or may alternatively form one single unitary component part. As a further alternative, the at least one driven shaft may be rotatable with respect to the pivotable bridge. Due to the arrangement of the at least one driven shaft on the pivotable bridge, a reciprocating pivoting of the pivotable bridge results in a back and forth movement of the at least one driven shaft. This back and forth movement of the at least one driven shaft is a movement on a circular path along only small angles (between 4 and 10 degree) which is close to a linear movement.

The housing of the electrically driven device may comprise a bearing insert or bearing portion with the intermediate shaft extending through the bearing insert. A sealing may be provided between the bearing insert and the intermediate shaft. Taking into account that the intermediate shaft performs a reciprocating pivoting movement by a small angle, for example about 6°, the sealing may comprise an elastically deformable sleeve fixed to the bearing insert and to the intermediate shaft. Such a sealing may contribute in closing off the housing or body portion of a shaver while a detachable shaver head may have to be cleaned in a cleaning liquid. In other words, the proposed device further improves sealing between different portions of the device, e.g. a shaver body and a shaver head. For example, a sealing separating an inner sealed compartment of the motor and elements of the transmission (body) with an outer unsealed area where the cutting parts and/or the shaving cartridge is located.

For example, the housing comprises a shaver body and a detachable shaver head. The electric motor, the drive shaft, the drive pin, the crank arm, the at least one elastically deformable element and the floating bearing may be located in the shaver body. Further, the at least one driven shaft and the pivotable bridge may be located in the shaver head. The intermediate shaft may extend partially in the shaver body and partially in the shaver head.

The at least one driven shaft of the electrically driven device may be coupled to a cutter unit, for example a lower, non-foil type cutter block reciprocating with respect to the fixed file type upper cutter member.

Preferably, the gear mechanism converts a continuous rotary motion of the drive shaft into an at least substantially sinusoidal reciprocating displacement driven shaft.

The proposed solution transfers and transmits the continuous rotation of an electric motor via a single oscillatory rotating transmission shaft, namely the intermediate shaft, to an arrangement of one or more, typically two or more, cutting elements which perform an oscillatory linear counteracting movement.

Further, the drive system with the gear mechanism may provide for an angled arrangement of the electric motor main axis, i.e. the first rotary axis, relative to the intermediate transmission shaft, which allows an easy installation of the drive system into shaver-architectures which have an angled head. The proposed device is effective by having no or merely a low loss of movement and efficient by having a low loss of energy even though the distance between the power input, i.e. the eccentric drive pin of the motor, and the power output, i.e. the driven shaft which may be a drive pin of a cutter unit, is relatively long.

The device provides a drive-train which may be at least partially arranged in the body to drive the cutting elements of a shaver arranged in a flexible and angled shaver head without the drawbacks of known devices. For example, the use of the intermediate shaft to transfer the mechanical power via an oscillatory rotating pin from the shaver body to the shaver head makes the stiffness of the transmission system independent of the distance between the motor and the cutting parts, while the stiffness of the transmission system is superior to known designs. In addition, the angle between a shaver head and a shaver body is not resulting in a loss of effectiveness of the drive system.

According to a further aspect, an overload clutch OC may be provided in the drive train between the drive shaft and the driven shaft(s), see FIG. 1. Such an overload clutch may be beneficial especially in a device with a high dynamical stiffness to avoid damage to the motor or the like. The overload clutch may be arranged and suitable for interrupting the power flow from the drive shaft to the driven shaft(s) at a predetermined threshold value. The overload clutch may re-engage if the load falls below the predetermined threshold value.

Further, the device may comprise at least one elastically deformable element EDE arranged and suitable for storing and releasing energy, see FIG. 1. For example, a torsion spring may be provided attached with one end to the intermediate shaft and with the other end to the housing or any other stationary component part. The reciprocating rotation of the intermediate shaft results in charging the spring as the intermediate shaft approaches one of its turning points. Charging the spring, thus, decelerates the intermediate shaft. At the turning point, when the intermediate shaft starts moving in the opposite direction, the spring accelerates the intermediate shaft, thereby releasing stored energy. This may contribute in reducing the force or torque exerted by the motor for driving the device. In addition, this may reduce wear and/or noise. As an alternative to the torsion spring attached to the intermediate shaft, at least one elastically deformable element, like a compression spring, a tension spring or a rubber block, may be arranged connected to a stationary component part and one of the reciprocating component parts of the device, e.g. the crank arm, the bridge or a cutter block.

Turning now to the embodiment depicted in FIG. 1, the electrically driven device comprises a motor 1 with a drive shaft 2. The drive shaft 2 defines a first rotary axis I. The drive shaft 2 is coupled to the drive pin 3 which is arranged eccentrically with respect to the drive shaft 2. This may be achieved by either directly coupling the drive pin 3 to the drive shaft 2 or by providing a gearing interposed between the drive shaft 2 and the drive pin 3.

Figure 4:
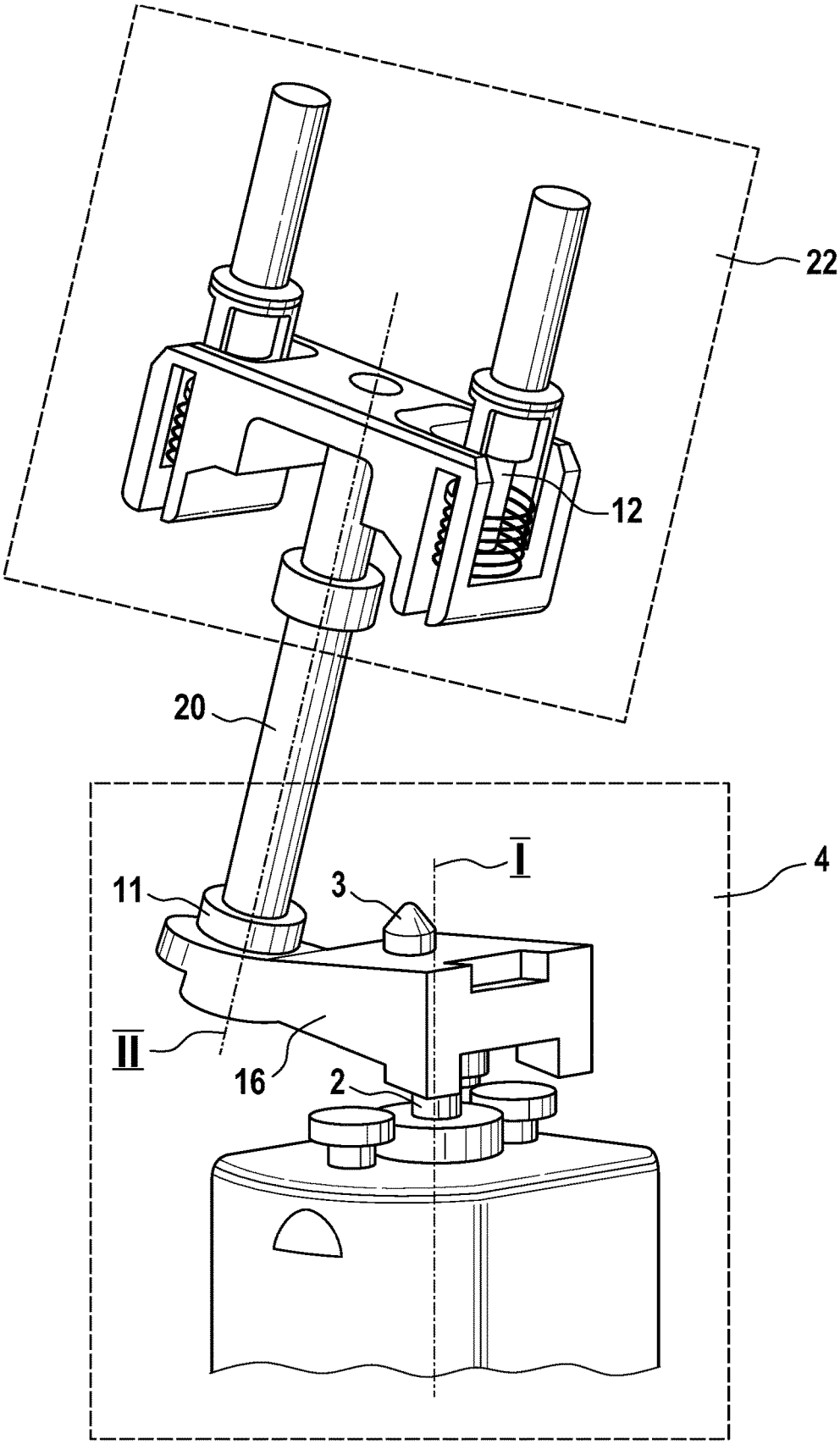
FIG. 4 shows a perspective view of component parts of the device of FIG. 3.

The motor 1 is received in a frame 4 which is constrained to or may be a part of a housing or body of the electrically driven device. The frame 4 is attached to or may be a unitary part of a bearing insert 5 or the like lid or cap. In FIG. 4, the housing or handle is schematically shown in dashed lines enclosing the motor 1. In addition, FIG. 4 shows a shaver head in dashed lines.

A first crank arm 6 is arranged in the housing such that the drive pin 3 engages a slotted hole in the first crank arm 6. The first crank arm 6 is pivotably guided by a bearing pin 7 which is held within frame 4. In the embodiment depicted in FIG. 1, the bearing pin 7 is arranged parallel to the first rotary axis I. In other words, the first crank arm 6 is pivotable in a plane perpendicular to the first rotary axis I.

At the left-hand side as seen in FIG. 1 the first crank arm 6 is provided with a further hole or recess which is engaged by a pin of a second crank arm 8. The second crank arm 8 is rotationally constrained to an intermediate shaft 9 which in turn is rotationally constrained to a pivotable bridge 10. In other words, rotation of the second crank arm 8 is transmitted via the intermediate shaft 9 to the pivotable bridge 10. The intermediate shaft 9 defines a second rotary axis II which is inclined with respect to the first rotary axis I. For example, the second rotary axis II may extend in a common plane with the first rotary axis I or in a plane parallel to the plane in which the first rotary axis I extends. The inclination of the second rotary axis II with respect to the first rotary axis I may be less than 60°, e.g. between 35° and 55°. Although an exemplary inclination of about 40° to about 50° is depicted in the Figures, a different inclination or no inclination may be chosen. The intermediate shaft 9 is rotatably guided about the second rotary axis II within the housing, that is bearing insert 5 in the example shown in FIG. 1, by means of bearing sleeves 11.

In the exemplary embodiment shown in FIG. 1, the pivotable bridge 10 is provided with two driven shafts 12 and an additional tappet 12*a*. Each of the driven shafts 12 and the tappet 12*a* is provided with an optional bearing sleeve 13 which is rotatable with respect to the respective driven shaft 12 or tappet 12*a* and which is axially displaceable with respect to the respective driven shaft 12 or tappet 12*a*, e.g. biased by a compression spring 14. As can be seen in FIG. 1, the two lateral driven shafts 12 are directly coupled to the pivotable bridge 10, for example the lateral driven shafts 12 may be rotationally and axially constrained to the pivotable bridge 10. In contrast to that the central tappet 12*a* is not directly coupled to the pivotable bridge 10. Rather, the central tappet 12*a* is coupled to the driven shaft 12 on the left-hand side as seen in FIG. 1 by means of a further bridge 15. The design arrangement of the bridge 15 will be explained in more detail below with respect to FIGS. 6 and 7 having a similar configuration. A slotted hole may be provided in the bridge 15 for coupling the bridge 15 to one of the driven shafts 12. The bridge 15 may be attached to the shaver head by means of legs (not shown in FIG. 1). As an alternative, the central tappet 12*a* and the further bridge 15 may be omitted. As a further alternative, the pivotable bridge 10 may be provided with only one single driven shaft 12.

Operation of the electrically driven device depicted in FIG. 1 will be explained below in more detail. In use motor 1 is activated such that the driven shaft 2 rotates about the first rotary axis I. This rotation is transferred to drive pin 3 rotating eccentrically about the first rotary axis I. Due to the engagement of drive pin 3 with the slotted hole in the first crank arm 6, rotation of drive pin 3 causes the first crank arm 6 to perform a reciprocating pivoting movement about bearing pin 7. This movement of the first crank arm 6 is transferred to the second crank arm 8 which in turn rotates the intermediate shaft 9. The reciprocating pivoting movement is further transferred by intermediate shaft 9 to pivoting bridge 10 and the driven shafts 12. Due to the offset of the lateral driven shafts 12 with respect to the second rotary axis II and the intermediate shaft 9, the lateral driven shafts 12 perform a back and forth movement along a circular path. This movement is close to a reciprocating longitudinal movement due to the small pivoting angle of the bridge 10 of e.g. 4° to 10°, preferably about 6° to about 7°.

Figure 2:
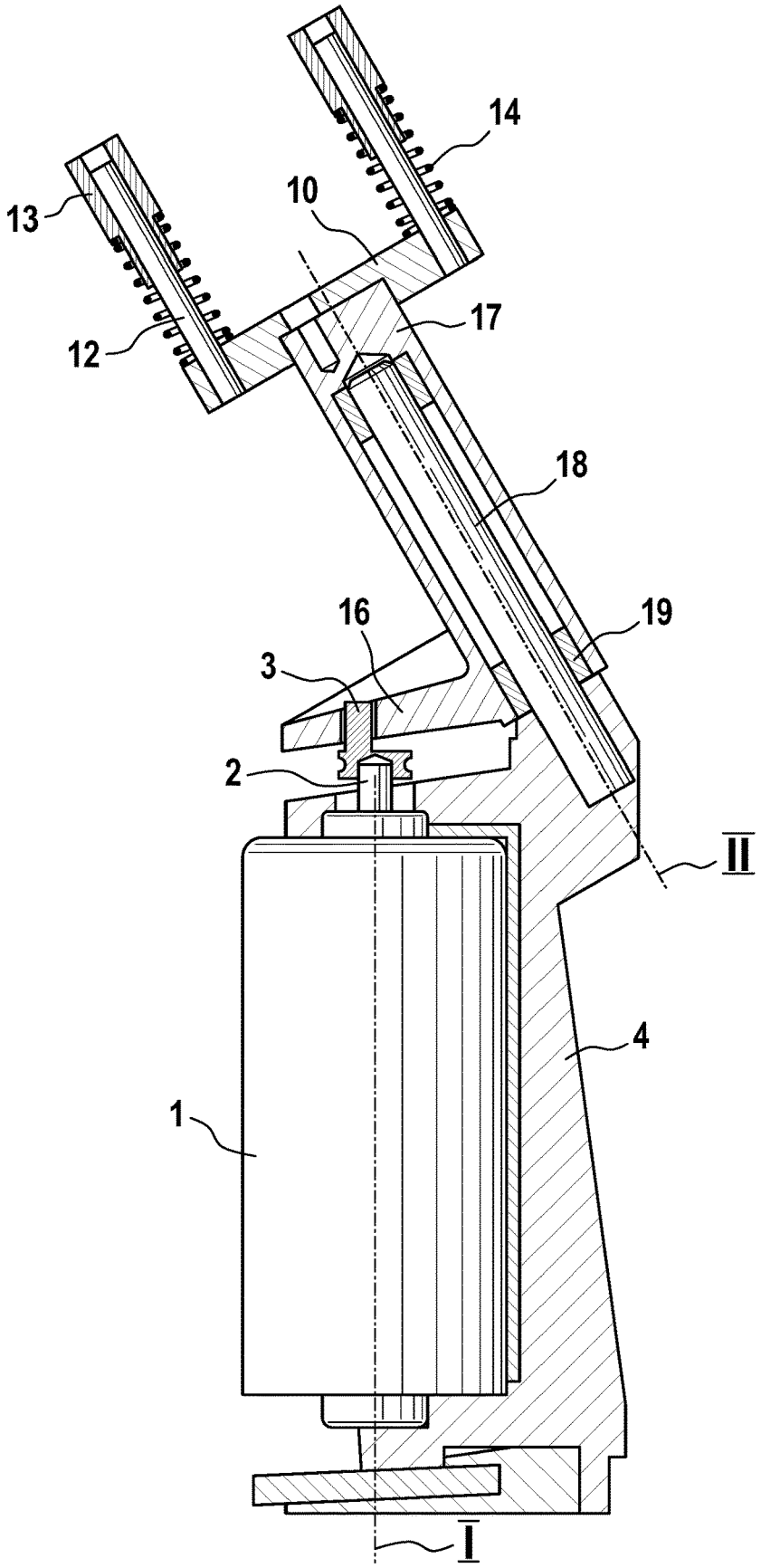
FIG. 2 shows a sectional view of a device according to a second embodiment.

A similar second exemplary embodiment is depicted in FIG. 2. Similar component parts of this second embodiment have like reference numerals as in the embodiment of FIG. 1. The main difference between the embodiment of FIG. 1 and the embodiment of FIG. 2 is the design of the gear mechanism between the drive pin 3 and pivotable bridge 10. In the second embodiment a single crank arm 16 which is an integral component part of the intermediate shaft 17 is arranged between drive pin 3 and pivoting bridge 10. The crank arm 16 is provided with a slotted hole which is engaged by the drive pin 3. The intermediate shaft 17 is a hollow shaft guided on a bearing pin 18 which is constrained to frame 4 of the housing. Bearing sleeves 19 are interposed between bearing pin 18 and intermediate shaft 17.

The function of the electrically driven device depicted in FIG. 2 is similar to that of the device depicted in FIG. 1. Rotation of drive shaft 2 causes rotation of the eccentric drive pin 3 which results in a reciprocating pivoting movement of crank arm 16 and intermediate shaft 17. The intermediate shaft 17 is rotationally constrained to pivotable bridge 10 which also performs a reciprocating pivoting movement. In the example of FIG. 2 the pivotable bridge 10 is provided with two driven shafts 12 which are arranged offset with respect to the second rotary axis II defined by the intermediate shaft 17. As an alternative, the pivotable bridge 10 may be provided with only one single driven shaft 12 or with more than two driven shafts 12, for example two driven shafts 12 and an additional tappet 12*a* as depicted in FIG. 1.

Figure 3:
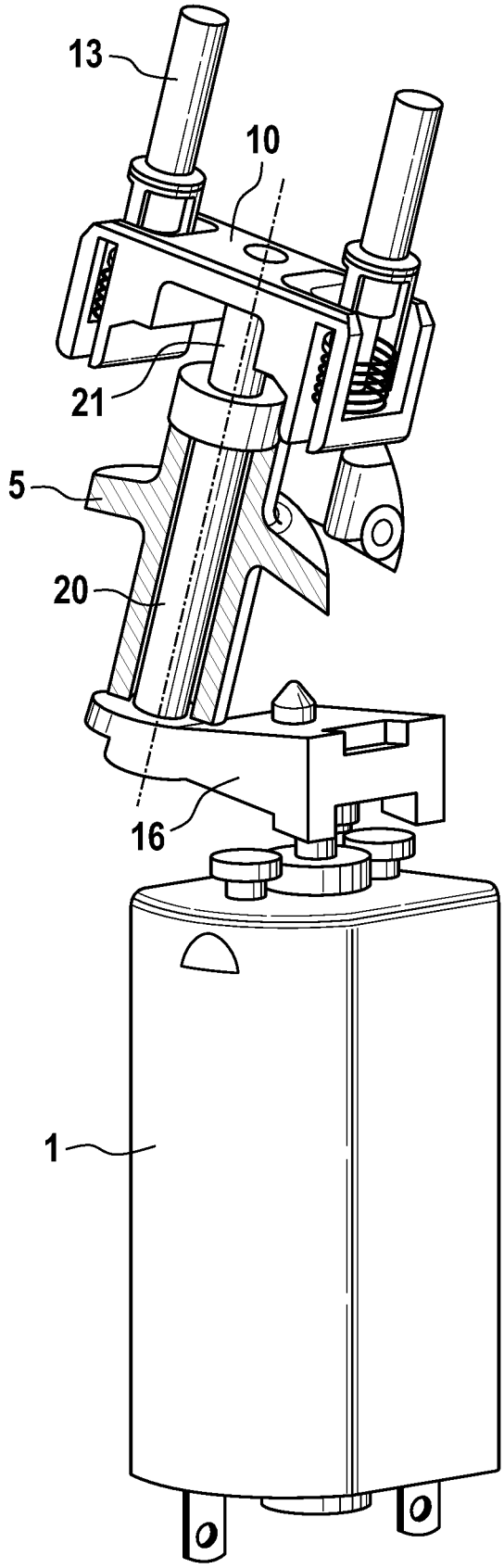
FIG. 3 shows a sectional view of a device according to a third embodiment.

A third exemplary embodiment is shown in FIGS. 3 and 4. Again, similar component parts have like reference numerals as in the exemplary embodiments of FIGS. 1 and 2. In the exemplary embodiment of FIGS. 3 and 4 a single crank arm 16 couples the drive pin 3 to the intermediate shaft 20 defining the second rotary axis II. The crank arm 16 and the intermediate shaft 20 are depicted as separate component parts. However, the crank arm 16 and the intermediate shaft 20 may be a single component part. In addition or as an alternative, the pivotable bridge 10 may be a single component part with the intermediate shaft 20 or may be a separate component part rotationally constrained to the intermediate shaft 20 as depicted in FIGS. 3 and 4. The intermediate shaft 20 is externally guided within bearing insert 5 by means of bearing sleeves 11. In addition, a sealing 21 is provided between the bearing insert 5 and the intermediate shaft 20. The sealing 21 may be a flexible sleeve compensating the reciprocating pivoting movement of the intermediate shaft 20 with respect to bearing insert 5 of e.g. 4° to 10°, preferably about 6° to about 7°.

Figure 6:
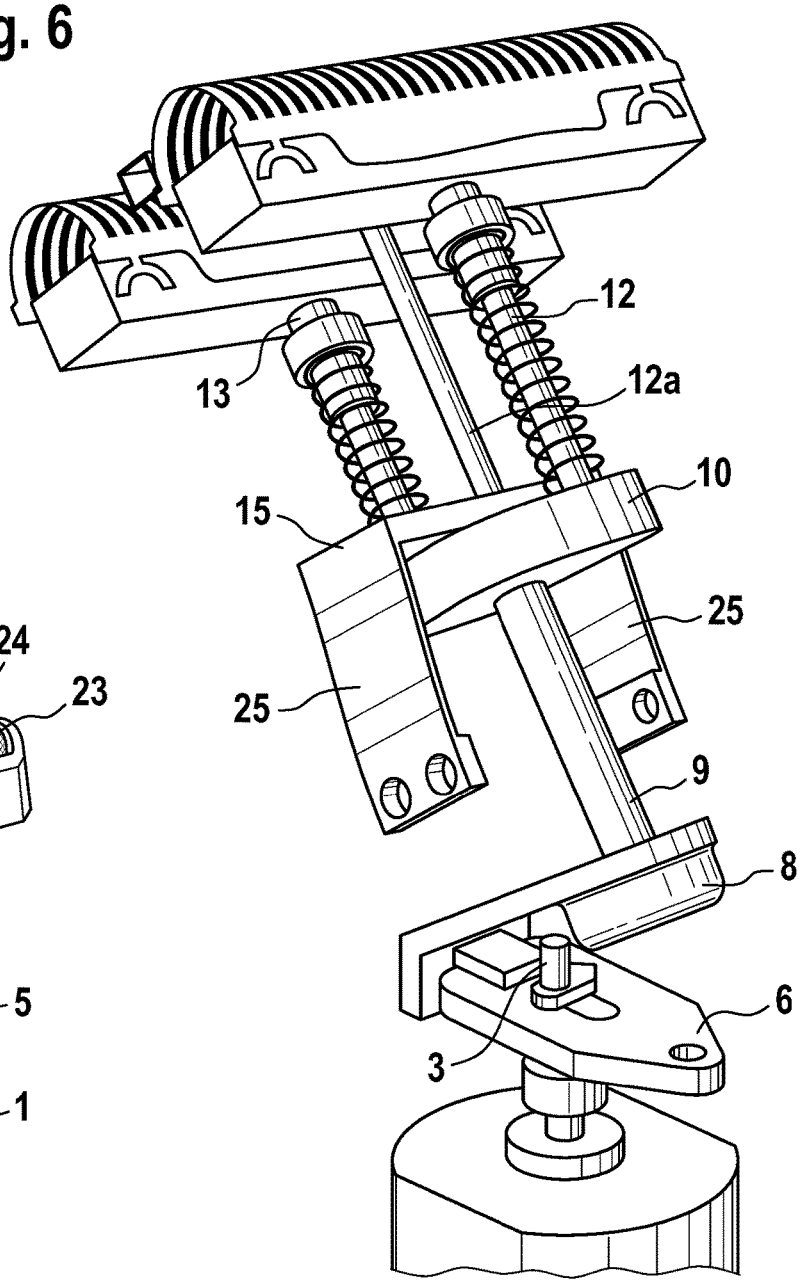
FIG. 6 shows a perspective view of component parts of the device of FIG. 5.
Figure 5:
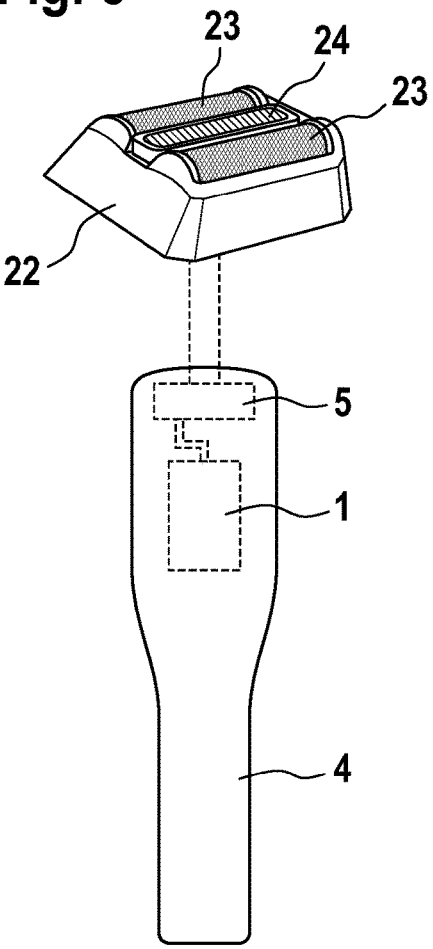
FIG. 5 shows a perspective view of a device according to a fourth embodiment.
Figure 7:
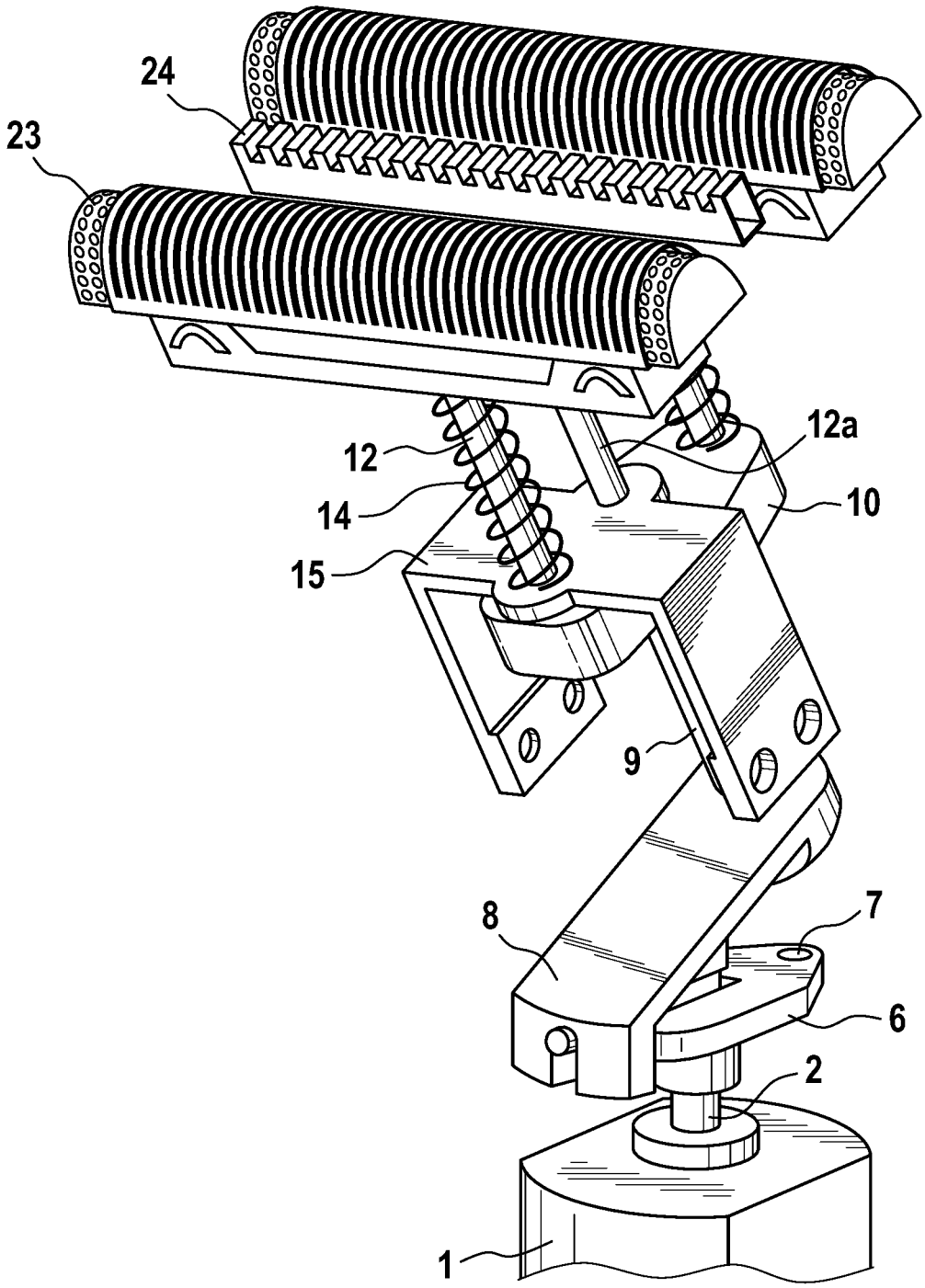
FIG. 7 shows a perspective view of component parts of the device of FIG. 5.

A still further exemplary embodiment of the electrically driven device is depicted in FIGS. 5 to 7. In this exemplary embodiment the electrically driven device is shown as an electric dry shaver with a shaver head 22 having two lateral foil type cutter units 23 and a central non-foil type cutter unit 24. The shaver head 22 may be detachably fixed to the not shown main body or housing of the shaver, e.g. in the manner allowing pivoting and/or swiveling of the shaver head 22 with respect to the main body or housing 4 around two horizontal axes which are perpendicular to each other, wherein the horizontal swivel axis is parallel to the movement direction of reciprocating lower cutter unit. In FIG. 5, the bearing insert 5 is schematically depicted in dashed lines without showing details of the interface between the shaver head 22 and the body frame 4. The gear mechanism interposed between the drive pin 3 and the pivotable bridge 10 of this further exemplary embodiment is substantially identical with the first exemplary embodiment depicted in FIG. 1, i.e. with two crank arms 6, 8 and an externally guided intermediate shaft 9. However, the pivotable bridge 10 is provided with two driven shafts 12 and a tappet 12*a* which are coupled to the cutter units 23 and 24 via the bearing sleeves 13. As in the exemplary embodiment of FIG. 1 the two lateral driven shafts 12 are directly connected to the pivotable bridge 10 with one of the lateral driven shafts 12 being further coupled to the central tappet 12*a* by means of a bridge 15. The bridge 15 may be integrally formed with two flexible legs 25 which are attached to a suitable portion of the housing such that the driven shaft 12 and the respective cutter units 23 and 24 are allowed to perform a reciprocating longitudinal movement. As an alternative to the flexible legs 25, the bridge 15 may be coupled to a housing portion by means of the separate levers. As a further alternative no flexible element with legs 25 is coupled to the drive train and rigid levers are implemented for coupling.

Figure 8:
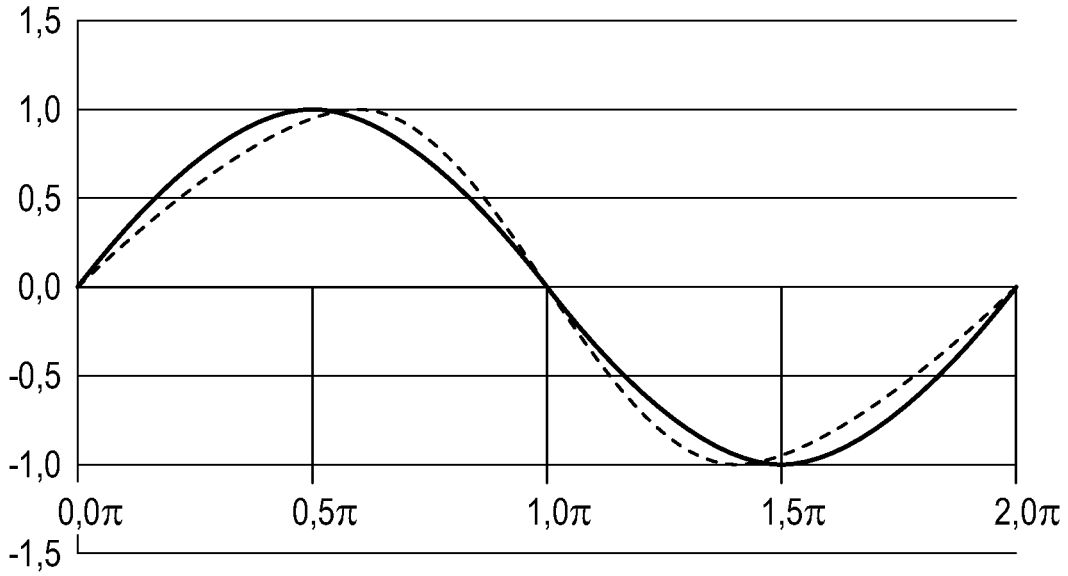
FIG. 8 shows a graph of the linear movement of a cutter block over one rotation of the drive shaft.

FIG. 8 exemplary shows a graph of the linear movement of a cutter block (displacement in mm at vertical axis), e.g. the non-foil type cutter lower unit 24, in mm over one full rotation of the drive shaft 2 (versus time at horizontal axis). The solid line in FIG. 8 depicts the movements in an electrically driven device according to the invention whereas the dashed line depicts a prior art device. While the solid line corresponds to a perfect sinusoidal behavior, deviations from this perfect sinusoidal movement are shown in the dashed line in that the maximum displacement of the cutter block is slightly offset from the 90° and 270° (i.e. 0.5 π and 1.5 π), respectively. While the derivative of a sinusoidal graph is again a (shifted) sinusoidal graph, deviations from a sinusoidal graph result in increased deviations in the respective derivative. In other words, if the movement departs from a sinusoidal behavior, the velocity further departs from a sinusoidal movement and the acceleration departs even more so from the sinusoidal behavior.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrically driven device comprising a housing, an electric motor mounted in the housing and comprising a drive shaft having a first rotary axis, a drive pin connected to the drive shaft eccentrically with respect to the rotary axis, and at least one driven shaft mounted in the housing for performing a movement relative to the housing, wherein the at least one driven shaft is indirectly coupled to the drive shaft by means of a gear mechanism converting a rotary motion of the drive shaft into a reciprocating motion of the at least one driven shaft, wherein the gear mechanism comprises one intermediate shaft having a second rotary axis extending in the longitudinal direction of the intermediate shaft and at least one crank arm coupled to the drive pin, wherein the crank arm is pivotably mounted in the housing and is coupled to the intermediate shaft near a first end of the intermediate shaft thereby converting a rotary motion of the drive shaft into a reciprocating pivoting of the intermediate shaft about the second rotary axis, wherein the intermediate shaft is coupled to the at least one driven shaft by means of a pivotable bridge such that the intermediate shaft is offset with respect to the at least one driven shaft and wherein the first rotary axis is inclined with respect to the second rotary axis, and wherein the pivotable bridge is coupled to the intermediate shaft near a second end of the intermediate shaft spaced from the first end.

2. The electrically driven device according to claim 1, wherein the gear mechanism comprises a first crank arm which is pivotably mounted in the housing and coupled to the drive pin and a second crank arm coupling the first crank arm to the intermediate shaft.

3. The electrically driven device according to claim 2, wherein the intermediate shaft is rotatably guided in the housing and rotationally constrained to the second crank arm.

4. The electrically driven device according to claim 2, wherein the first crank arm is pivotable about an axis parallel to the first rotary axis and the second crank arm is pivotable about an axis parallel to the second rotary axis.

5. The electrically driven device according to claim 1, wherein the gear mechanism comprises one crank arm which is pivotably mounted in the housing, coupled to the drive pin and rotationally constrained to the intermediate shaft.

6. The electrically driven device according to claim 5, wherein the crank arm is an integral part of the intermediate shaft.

7. The electrically driven device according to claim 1, wherein the intermediate shaft is a hollow shaft internally guided in the housing by means of a bearing pin.

8. The electrically driven device according to claim 1, wherein the intermediate shaft is externally guided in the housing by means of at least one bearing sleeve.

9. The electrically driven device according to claim 1, wherein the drive pin is coupled to the at least one crank arm with a clearance fit in at least one direction perpendicular to the first rotary axis.

10. The electrically driven device according to claim 1, wherein the intermediate shaft is rotationally constrained to the pivotable bridge which is rotationally constrained to the at least one driven shaft.

11. The electrically driven device according to claim 1, wherein the housing comprises a bearing insert with the intermediate shaft extending through the bearing insert, wherein a sealing is provided between the bearing insert and the intermediate shaft.

12. The electrically driven device according to claim 1, wherein the housing comprises a shaver body and a detachable shaver head, wherein the electric motor, the drive shaft, the drive pin and the at least one crank arm are located in the shaver body, wherein the at least one driven shaft and the pivotable bridge are located in the shaver head and wherein the intermediate shaft extends partially in the shaver body and partially in the shaver head.

13. The electrically driven device according to claim 1, wherein the at least one driven shaft is coupled to a cutter unit.

14. The electrically driven device according to claim 1, wherein the gear mechanism converts a continuous rotary motion of the drive shaft into an at least substantially sinusoidal reciprocating displacement driven shaft.

15. The electrically driven device according to claim 1, wherein an overload clutch is provided between the drive shaft and the at least one driven shaft.

16. The electrically driven device according to claim 1, wherein at least one elastically deformable element is arranged interposed between a stationary component part and one of the one intermediate shaft, the crank arm and the pivotable bridge.

* * * * *